US005454314A

United States Patent [19]

Fischer

[11] Patent Number: 5,454,314

[45] Date of Patent: Oct. 3, 1995

[54] APPARATUS FOR EMPTYING INK DUCTS

[75] Inventor: Christian M. M. Fischer, Marktheidenfeld, Germany

[73] Assignee: Koenig & Bauer Aktiengesellschaft, Wurzburg, Germany

[21] Appl. No.: 96,992

[22] Filed: Jul. 27, 1993

[30] Foreign Application Priority Data

Jul. 27, 1992 [DE] Germany ..... 42 24 775.6

[51] Int. Cl.[6] ..... B41F 31/06; B41F 31/20

[52] U.S. Cl. ..... 101/363

[58] Field of Search ..... 101/425, 350, 101/363, 207–210, 148, 364, 365, 330, 331, 351, 355, 356, 360

[56] References Cited

U.S. PATENT DOCUMENTS

| | | | |
|---|---|---|---|
| 1,772,470 | 8/1930 | Snyder | 101/425 |
| 2,666,386 | 1/1954 | Jovishoff et al. . | |
| 3,094,924 | 6/1963 | Stark . | |
| 3,978,788 | 9/1976 | Cappel et al. . | |
| 4,357,871 | 11/1982 | Kobler et al. . | |
| 4,357,872 | 11/1982 | Simeth et al. . | |
| 4,425,777 | 1/1984 | Jeglinski | 72/325 |
| 4,574,698 | 3/1986 | Mesker | 101/425 |
| 4,632,030 | 12/1986 | Leverick | 101/425 |
| 5,009,934 | 4/1991 | Wenski et al. | 427/387 |
| 5,027,513 | 7/1991 | Allison | 101/169 |
| 5,110,415 | 5/1992 | Boucher et al. | 162/281 |
| 5,125,341 | 6/1992 | Yaeso | 101/367 |
| 5,293,819 | 3/1994 | Fukuda | 101/350 |

FOREIGN PATENT DOCUMENTS

| | | |
|---|---|---|
| 1130453 | 6/1959 | Germany . |
| 2629331 | 6/1978 | Germany . |
| 2929891 | 1/1981 | Germany . |
| 2951649 | 7/1981 | Germany . |
| 3806400 | 9/1989 | Germany . |
| 9113480 | 2/1992 | Germany . |

OTHER PUBLICATIONS

Patent Abstracts of Japan; Publication No. JP2098446; Publication Date: Oct. 24, 1990.

*Primary Examiner*—J. Reed Fisher
*Attorney, Agent, or Firm*—Jones, Tullar & Cooper

[57] ABSTRACT

Excess ink is emptied from an ink duct of a rotary printing machine and is deposited in a collecting container which is removably secured to the ink duct adjacent an upper end of an inclined bottom of the ink duct. A hand manipulable doctor blade is usable to transfer the ink out of the ink duct and into the excess ink collecting container.

6 Claims, 2 Drawing Sheets

APPARATUS FOR EMPTYING INK DUCTS

FIELD OF THE INVENTION

The present invention is directed generally to a method and apparatus for emptying ink ducts. More particularly, the present invention is directed to a method and apparatus for emptying ink ducts in rotary printing presses. Most specifically, the present invention is directed to a method and apparatus for emptying excess ink from ink ducts into an excess ink collection container. The collection container is removably suspended at an upper, rear portion of the ink duct. A cooperatively sized ink removal doctor blade is insertable into the ink duct and is then manipulated to pull the ink to be removed from the ink duct up and out of the ink duct and into the excess ink collection container. Once the excess ink has been removed, the collection container can be separated from the ink duct.

DESCRIPTION OF THE PRIOR ART

Ink duct assemblies are well known for use with rotary printing presses to supply printing ink to the appropriate printing plates and cylinders. These ink duct assemblies must periodically be cleaned, either for routine maintenance or when the color being used is to be changed. In the course of cleaning these ink ducts of inking systems for rotary printing presses and in particular for sheet-fed rotary printing, it is generally known to separate the ink duct from the ink ductor roller to accomplish this cleaning. This separation is typically accomplished by pivoting the ink duct away from the ink ductor roller in a manner in which the lower point of the ink duct is pivotable about an axis. A pivotable ink duct of this general type is shown in German published, examined patent application No. DE-AS 26 39 331. In devices of this type, it is necessary that the ink supply in the ink duct be removed before the ink duct is pivoted away from the ink ductor roller. Typically, the press operator uses a spatula or a similar tool to remove the excess ink from the ink duct and to place it in a suitable container. Such a procedure is clearly time consuming and inefficient.

A different type of ink duct assembly for a rotary printing press is shown in German published, unexamined patent application No. DE-OS 29 29 891. In this prior art device the ink duct includes an upper part and a lower part with an ink blade that is positionable against the ink ductor roller in such a way that the upper part, which is structured as an ink reservoir is removably disposed on the lower part supporting the ink blade. A limitation of this prior art device is that, when there are being used a number of different colors of ink, that it is necessary to stock a plurality of ink reservoirs so that these reservoirs can be used to facilitate ink changes.

It will thus be seen that a need exists to accomplish the expeditious ink removal from ink ducts. The method and apparatus for emptying ink ducts in accordance with the present invention accomplishes this goal and is a significant improvement over the prior art.

SUMMARY OF THE INVENTION

It is an object of the present invention to provide a method and apparatus for emptying ink ducts.

A further object of the present invention is to provide a method and apparatus for emptying ink ducts in rotary printing presses.

Another object of the present invention is to provide a method and apparatus for emptying ink ducts into an excess ink collection container.

Still a further object of the present invention is to provide a method and apparatus for emptying ink ducts using a hand-manipulated doctor blade.

Yet another object of the present invention is to provide a method and apparatus for emptying ink ducts in a rotary printing press into a removable excess ink collection container.

Even still a further object of the present invention is to provide a method and apparatus for emptying ink ducts of rotary printing presses in which the excess ink can be removed from the ink duct quickly and without great effort when changing the ink duct or during cleaning operations.

As will be discussed in detail in the description of the preferred embodiment which is set forth subsequently, the method and apparatus for emptying ink ducts in a rotary printing press in accordance with the present invention utilizes an excess ink collecting container. This container is removably supported at the upper rear portion of the sloping floor of the ink duct. A hand manipulatable doctor blade is insertable into the ink duct, generally adjacent the ink ductor roller, and can be moved away from the axis of rotation of the ductor roller and up the inclined sloping floor of the ink duct. As the doctor blade or scraper is moved in this manner, the ink in the ink duct is caused to flow into a collection compartment of the excess ink collection container. Once the ink has been removed from the ink duct and deposited in the container, the container can be removed so that the ink duct can be manipulated for cleaning or maintenance in a generally conventional manner.

The method and apparatus for emptying ink ducts in accordance with the present invention provides several advantages when compared with the prior art. The excess ink in the ink duct can be quickly and efficiently removed by using the hand-manipulatable doctor blade. This allows all of the excess ink to be pulled out of the ink duct by movement of the doctor blade along the inclined bottom surface of the ink duct. The doctor blade or scraper is sized to be effectively as wide as the ink duct. Once the ink has been removed from the ink duct into the excess ink collection container, the ink duct is again ready for use or can be manipulated in a conventional manner for further cleaning.

The doctor blade or scraper in accordance with the present invention is provided with a doctor blade strip that is selected so that it will always be softer than the ink ductor roller. The selection of the working edge material in this manner insures that the ink ductor and the bottom of the ink duct are treated in a gentle manner and are not damaged.

The method and apparatus for emptying ink ducts in accordance with the present invention overcomes the limitations of the prior art and is a substantial advance in the art.

BRIEF DESCRIPTION OF THE DRAWINGS

While the novel features of the method and apparatus for emptying ink ducts in accordance with the present invention are set forth with particularity in the appended claims, a full and complete understanding of the invention may be had by referring to the detailed description of the preferred embodiment which is presented subsequently, and as illustrated in the accompanying drawings, in which:

DESCRIPTION OF THE PREFERRED EMBODIMENT

Figure 1:
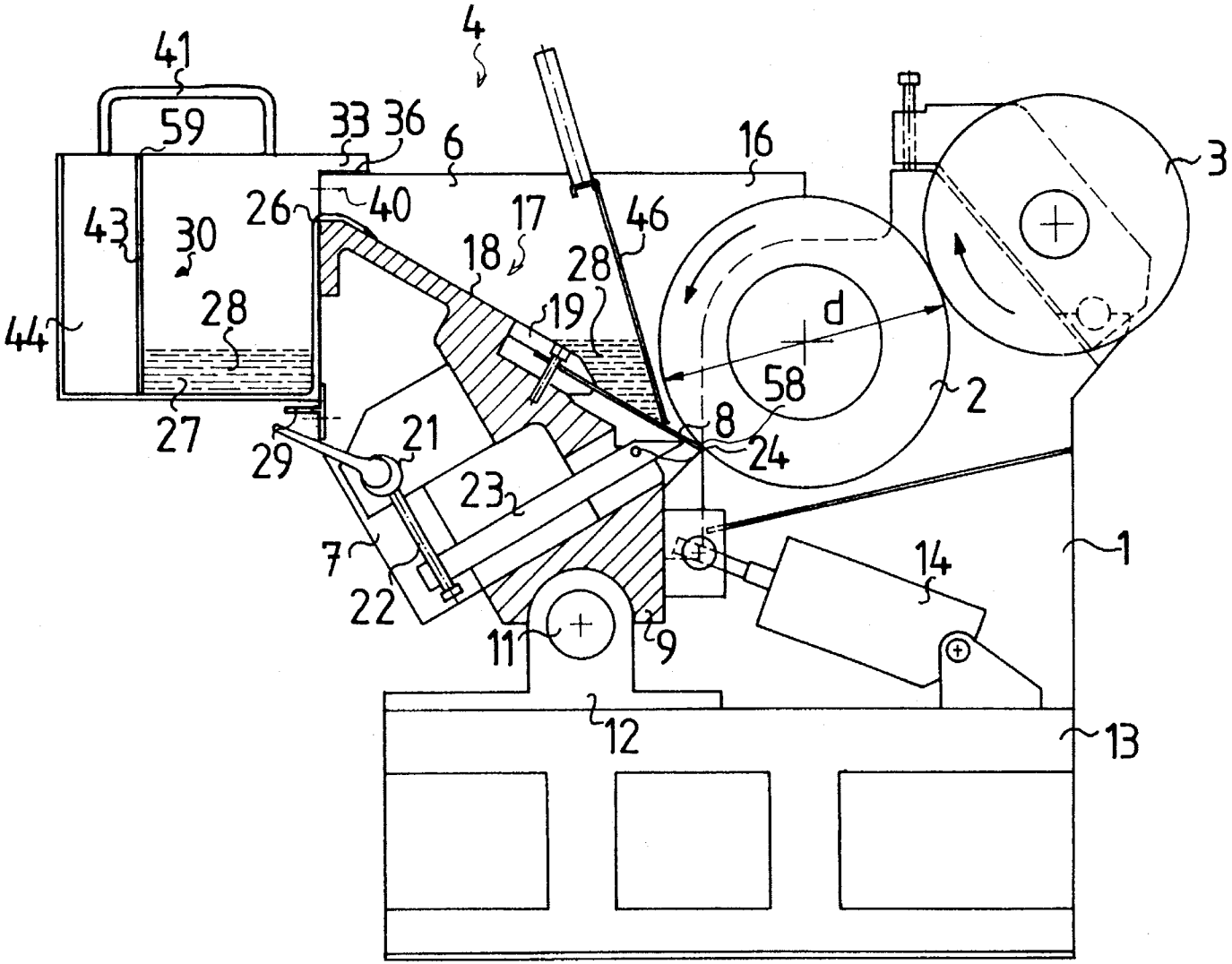
FIG. 1 is a schematic side elevation view of portions of an inking system with an ink duct and showing the apparatus in accordance with the present invention in an intermediate position.

Referring initially to FIG. 1, there may be seen a portion of an inking system of a rotary printing press for use in a sheet-fed offset printing assembly. It will be understood that only the portions of the inking system which are essential to an understanding of the subject invention are shown in the schematic view of FIG. 1 and that the remainder of the sheet-fed offset printing assembly is not shown.

The inking system depicted in FIG. 1 utilizes an ink ductor roller 2 and a film roller 3 which are rotatably supported in a press frame, generally at 1. An ink application device, generally at 4 in FIG. 1 can be placed against the ink ductor roller 2 and is used to provide printing ink to the ink ductor roller 2 and thence to the ink film roller 3 is a generally known manner. The ink application device 4 includes an ink duct or reservoir 6 which receives printing ink from a suitable source of supply. An associated adjustment mechanism, generally at 7, which will be discussed in detail subsequently, is used to adjust the spacing of one or more doctor blades 8 so that the amount of ink applied from the ink duct or reservoir 6 to the ink ductor roller 2 will be adjusted. The ink duct 6 can be provided in conjunction with one or more adjustment devices 7 in full-width, half-width or quarter-width sizes depending on the printing requirements of the material being printed by the printing press.

Referring again to FIG. 1, the ink application device, generally at 4, is provided with spaced journals 11 along its lower base portion 9 with these journals 11 being rotatably supported in suitable bearings 12 which are secured to the press frame 1. A cross arm 13 extends between the sides of the press frame and carries the bearings 12. One or more working cylinders 14, which may be hydraulic or pneumatic, are secured at first ends to the cross arm 13 and at second ends to the ink application device 4 generally above the pivot line of the journal 11 of the base frame 9 in the bearings 12. Actuation of the working cylinders 14 will pivot the ink application device 4 about its journals 11 into a rest position in which the ink reservoir of the ink application device is moved away from the ink ductor roll 2. This movement will increase the space between the end of the ink doctor blade or blades 8 with respect to the ink ductor roll 2 and can thus only be done after any ink in the ink reservoir has been emptied or removed.

The ink reservoir of the ink application device 4 is formed by the ink ductor roll 2 in cooperation with laterally spaced side plates 16. These side plates 16 are generally shaped as inverted triangles with their apexes pointing toward the journals 11 and with one side of each such side plate 16 being arcuately shaped to cooperatively engage the circumference of the ink ductor roll 2. An inclined or sloping bottom surface 17 of the ink reservoir of the ink application device 4 is formed by a top surface 18 of the housing which supports the adjustment device 7. This bottom portion 17 slopes downwardly toward the ink ductor roll 2. The bottom portion 17 is also formed by holders 19 for the ink doctor blade or blades 8. The adjustment device, generally at 7, which supports the ink reservoir of the ink application device 4, utilizes eccentric cams 21 which are connected by transfer members, such as elongated screws or bolts 22, with blade adjustment levers 23 which, in turn, engage the ink doctor blades 8. These adjustment levers 23 are pivotably supported at their inner ends adjacent the ink blades 8 by a shaft 24 which is supported in the housing of the adjustment assembly generally parallel to the axis of rotation of the ink ductor roller 2. Rotation of the cams 21 will be transferred by the transfer members 22 to the blade adjustment levers 23 so that the ends of the ink doctor blade or blades 8 can be moved toward or away from the ink ductor roll 2.

An excess ink collection container, generally at 27 is supported at an upper edge 26 of the top 18 of the housing for the ink application device 4. This upper edge 26 defines the upper terminus of the bottom 17 of the ink duct. As may be seen more clearly in FIG. 2, the collecting container 27 is generally cubical in shape and has a forwardly extending fastening strip 25 which extends over the upper edge 26 of the bottom 17 when the collecting container 27 is placed generally at the rear of the ink application device 4. The slope of the fastening strip 25 is selected to be the same as the slope of the bottom 17 so that excess ink 28 can be swept up the bottom 17 and into the ink collecting container 27. A generally T-shaped cover member 29 is positioned generally beneath the fastening strip 25 so that any excess ink which may find its way between the fastening strip 25 and the bottom 17 of the ink duct will not fall onto the adjustment device 7 which includes the eccentric cams 21 and their adjustment levers.

Figure 3:
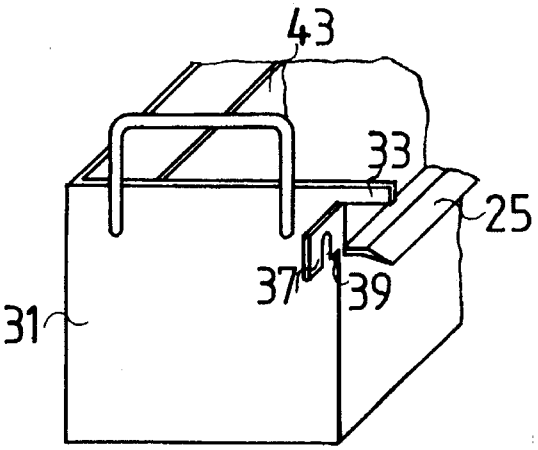
FIG. 3 is an enlarged detail view of a portion of the collecting container of FIG. 2.
Figure 2:
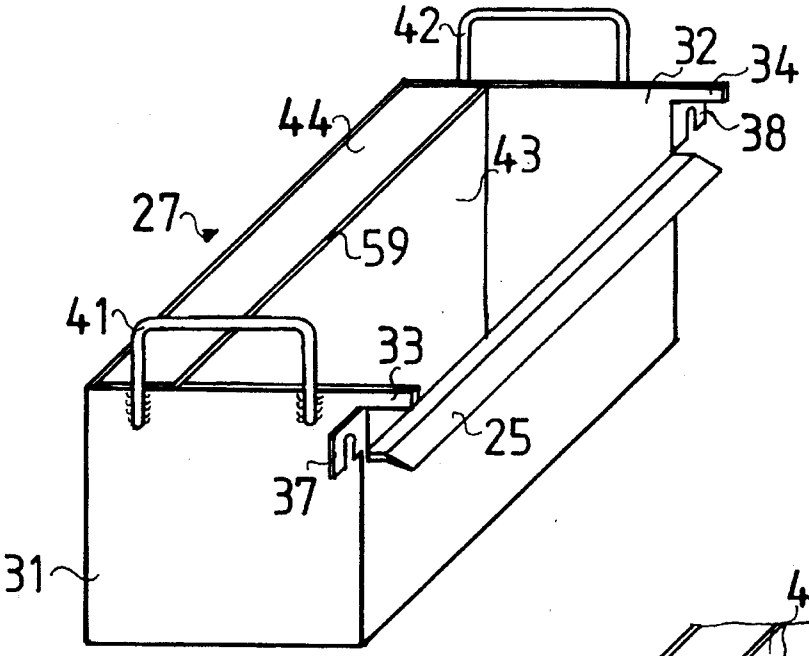
FIG. 2 is a perspective view of the excess ink collecting container of the present invention.

The excess ink collecting container 27 has two end faces 31 and 32 which each carry a support bracket 33 and 34 respectively, as seen most clearly in FIGS. 2 and 3. These support brackets 33 and 34 extend forwardly toward the ink ductor roller 2 and are generally perpendicular to the plane of the fastening strip 25. When the collecting container 27 is positioned for use at the upper end of the bottom 17 of the ink duct, these forwardly extending support brackets 33 and 34 sit atop upper faces or edges 36 of the lateral side plates 16. As may also be seen in FIGS. 2 and 3, a pair of securing brackets 37 and 38 extend laterally out to the sides of the collecting container 27 generally between the support brackets 33 and 34 and the fastening strip 25. These securing brackets 37 and 38 are provided with cut outs or slots 39, as seen in FIG. 3, with these cut outs 39 being sized to slide over fastening elements 40, such as screws which are connected to the lateral side plates 16, as is depicted schematically in FIG. 1. Thus the excess ink collecting container 27 is supported at the upper edge 26 of the bottom 17 of the ink duct by its fastening strip 25, its support brackets 33 and 34, and its securing brackets 37 and 38. A pair of suitable carrying members, such as handles 41 and 42 are secured to the upper portions of the container ends 31 and 32. These handles 41 and 42 facilitate handling and transport of the excess ink collecting container 27. The container 27 can have a width which can be the full width of the ink duct, one half the width of the ink duct, or one quarter of the width of the ink duct. A generally vertically extending separation wall 43 may be placed in the container 37 generally parallel to the container's spaced front and rear walls. This separating wall 43 divides the interior of the excess ink collecting container 27 into an excess ink receiving chamber 30 and a storage container 44 for various utensils and the like. The excess ink collecting container 27 may be made of sheet metal or another suitable material.

Figure 4:
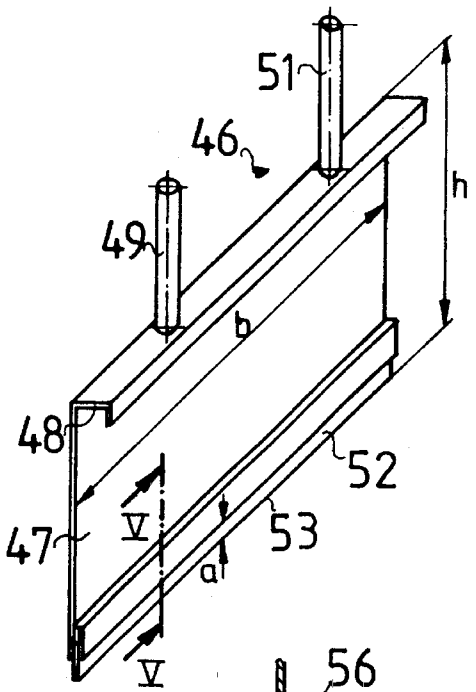
FIG. 4 is a perspective view of a doctor blade for use in the present invention.
Figure 5:
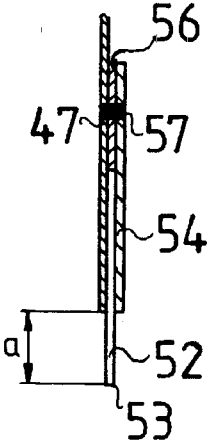
FIG. 5 is a sectional view of the doctor blade taken along line V—V of FIG. 4.

Turning again to FIG. 1 and also referring to FIGS. 4 and 5, a hand-manipulable doctor blade or scraper, generally at 46, is used to pull or direct the ink from the ink duct, up the inclined bottom 17 and into the ink receiving compartment 30 of the excess ink collecting container 27. This doctor blade 46 utilizes a sheet metal body plate 47 whose width "b" is selected to be generally the same as the width of the ink duct between spaced lateral side plates 16. The overall height "h" of the sheet metal plate, and an associated doctor blade strip 52 which is carried at the bottom of plate 47 is approximately the same as the diameter "d" of the ink ductor roll 2. An upper edge 48 of the metal plate 47 of the hand manipulable doctor blade 46 is bent generally at 90 degrees to the plate 47 to form a top flange 48. This edge or top flange 48 carries upwardly extending handles 49 and 51 which are intended to be grasped by an operator so that he can manipulate the doctor blade 46. The handles 49 and 51 are depicted schematically in FIG. 4 and could have any desired shape.

As indicated above, and as may be seen most clearly in FIG. 5, the bottom portion of the metal plate 47 of the hand manipulable doctor blade 46 carries a doctor blade strip 52. This doctor blade strip is held between the lower portion of the plate 47 and a sheet metal holding strip 54, which is maintained in a spaced position from the plate 47 by shims 56. Suitable rivets 57 or other fastening elements are utilized to secure the sheet metal strip holder 54 to the metal plate 47. The doctor blade strip 52 extends across the width "b" of the doctor blade 46 and has a lower working edge 53 which will contact the bottom 17 of the ink duct when the hand manipulable doctor blade 46 is utilized to remove excess ink from the ink duct and to pull it into the ink storage compartment 30 of the collecting container 27.

As may be seen in FIGS. 4 and 5, the doctor blade strip 52 has a working height "a" of between approximately 10 and 80 mm. This doctor blade strip 52 is always made of a material which is softer than the material used for the ink ductor roll 2. Various materials, such as brass, a suitable plastic such as polyoximethylene (POM) or rubber are usable as the doctor blade strip 52.

In operation to remove excess ink 28 from the ink duct, the excess ink collecting container 27 is first placed at the upper rear edge 26 of the bottom 17 of the ink duct. The hand manipulable doctor blade 46, whose width "b" is the same as the width of the ink duct between adjacent spaced lateral side plates 16, is inserted into the ink duct 6 with the edge 53 of the doctor blade strip 52 being kept in contact with the ink ductor roll 2. Once the edge 53 of the doctor blade strip contacts the bottom 17 of the ink duct or reservoir 6 generally in the area of the line of contact 53 between the adjustable ink doctor blade 8 and the ink ductor roll 2, the hand manipulable doctor blade 46 can be moved up the inclined bottom 17 and toward the excess ink collecting container 27. This upward sweeping movement of the hand manipulable doctor blade 46 will pull or sweep the excess ink 28 over the fastening strip 25 and into the excess ink storage chamber 30 of the collecting container 27. This sweeping movement of the hand manipulable doctor blade can be repeated several times until all of the excess ink 28 remaining in the ink duct or reservoir 6 has been placed in the storage chamber 30. Any excess ink remaining on the doctor blade 46 can be scraped off using an upper edge 59 of the separating wall 43 of the collecting container 27. This upper edge 59 of the separating wall 43 can be bent or angled toward the ink ductor roll 2 to facilitate removal of excess ink from the doctor blade 46. Once all of the excess ink 28 has been transferred from the ink duct 6 to the collection container 27, the hand manipulable doctor blade 46 can be placed in the storage compartment portion 14 of the container 27. The collecting container 27 can then easily be lifted by its handles 41 and 42 and can be removed from the ink application device 4. Once the collecting container 27 has been elevated vertically and removed, the ink application device 4 can be pivoted away from the ink ductor roll 2 by actuation of the work cylinders 14 so that the ink application device 4 can be cleaned or repaired, as needed.

As was discussed above, the material used for the doctor blade strip 52 is selected so that it will be softer than the material used for the ink ductor roller 2. This insures that the ink ductor roller 2 will not be damaged by the hand manipulable doctor blade 46. The doctor blade 46 could also be made of a single material and in one piece. The width "b" of the doctor blade 46 can correspond to half or to all of the clear width of the ink duct with which it will be used. The height "h" of the doctor blade 46 need not be exactly the same as the diameter "d" of the ink ductor roll 2 but should be generally the same.

While a preferred embodiment of a method and apparatus for emptying ink ducts in accordance with the present invention has been set forth fully and completely hereinabove, it will be apparent to one of skill in the art that a number of changes in, for example, the overall size of the ink duct, the type of ink being emptied, the types of bearings and supports used and the like may be made without departing from the true spirit and scope of the present invention which is accordingly to be limited only by the following claims.

I claim:

1. An apparatus usable to empty excess ink from an ink duct of a rotary printing press, said apparatus comprising:

an ink application device including an ink duct having an inclined bottom surface and an ink ductor roller;

an excess ink collecting container having spaced front and rear walls and spaced end walls and being removably securable to an upper edge of said inclined bottom surface of said ink duct, said excess ink collecting container having a fastening strip which is engageable with said upper edge of said inclined bottom surface of said ink duct and which has an angle of inclination which cooperates with said inclined surface of said ink duct;

securing brackets secured to said end walls of said excess ink collecting container and support brackets provided on said end walls, said securing brackets being engageable with said ink duct to removably support said excess ink collecting container on said ink application device; and a hand manipulable doctor blade insertable in said ink duct and engageable with said ink ductor roller and said bottom surface, said hand manipulable doctor blade being usable to transfer excess ink from said ink duct to said excess ink collecting container.

2. The apparatus of claim 1 wherein blade useable for emptying an ink duct of an ink application device said doctor blade comprises a rectangular doctor blade plate having a width which cooperates with a width of said ink duct and a height which cooperates with a diameter of said ink ductor roller and a doctor blade strip secured to a lower portion of said doctor blade plate, said doctor blade strip having a working edge.

3. The doctor blade of claim 2 wherein said doctor blade strip is brass.

4. The doctor blade of claim 2 wherein said doctor blade strip is rubber.

5. The doctor blade of claim 2 wherein said doctor blade strip is plastic.

6. The doctor blade of claim 5 wherein said plastic is polyoximethylene.

* * * * *

UNITED STATES PATENT AND TRADEMARK OFFICE

CERTIFICATE OF CORRECTION

PATENT NO. : 5,454,314

DATED : October 3, 1995

INVENTOR(S) : Christian M. M. FISCHER

It is certified that error appears in the above-indentified patent and that said Letters Patent is hereby corrected as shown below:

Column 6:
Claim 2, line 66, after "wherein" cancel "blade useable for"; and
line 67, before "said" cancel "emptying an ink duct of an ink application device".

Signed and Sealed this

Twenty-sixth Day of December, 1995

Bruce Lehman

*Attest:*

BRUCE LEHMAN

*Attesting Officer*

*Commissioner of Patents and Trademarks*